US006283344B1

(12) United States Patent
Bradley

(10) Patent No.: US 6,283,344 B1
(45) Date of Patent: Sep. 4, 2001

(54) HANDS FREE PERSONAL HYDRATION DELIVERY SYSTEM

(76) Inventor: Todd H. Bradley, 2809 Al La'i Rd., Honolulu, HI (US) 96816

( * ) Notice: Subject to any disclaimer, the term of this patent is extended or adjusted under 35 U.S.C. 154(b) by 0 days.

(21) Appl. No.: 09/333,531

(22) Filed: Jun. 15, 1999

Related U.S. Application Data

(60) Provisional application No. 60/125,402, filed on Mar. 20, 1999.

(51) Int. Cl.[7] ..... A45F 5/00

(52) U.S. Cl. ..... 224/148.2; 224/148.5; 224/181; 222/175

(58) Field of Search ..... 224/148.1, 148.2, 224/148.4–148.7, 181; 222/175; 2/12, 422

(56) References Cited

U.S. PATENT DOCUMENTS 4,681,244 * 7/1987 Geddie ..... 222/175 X
4,739,905 * 4/1988 Nelson ..... 224/148.2 X
4,813,083 * 3/1989 Davidson ..... 2/422
5,104,016 * 4/1992 Runkel ..... 224/148.2
5,148,950 * 9/1992 Hasaka ..... 224/181 X
5,265,769 * 11/1993 Wilson ..... 224/148.2 X
5,601,207 * 2/1997 Paczonay ..... 224/148.2 X
5,755,368 * 5/1998 Bekkedahl ..... 224/148.2 X
5,816,457 * 10/1998 Croft ..... 224/148.2
5,970,523 * 10/1999 Atkins ..... 222/175 X
5,984,145 * 11/1999 McAllister ..... 224/148.2 X

* cited by examiner

*Primary Examiner*—Gregory M. Vidovich
(74) *Attorney, Agent, or Firm*—Leighton K. Chong

(57) ABSTRACT

A hands-free personal hydration delivery system has a tubing assembly that has one end that detachably connects to a feed tube for a container of fluid worn on the back or torso of a user. The other end of the tubing assembly is coupled to a bite valve which is opened when manipulated by the user's mouth to allow fluid to be drawn by suction applied by the user, and is closed when not being manipulated so as to cut off fluid flow in an air-tight condition. An intermediate portion of the tubing assembly is mounted on the user's head or to the user's headgear at a position of higher elevation than the user's mouth. This allows fluid to be drawn to the elevated position and flow downward from there to the user's mouth by gravity feed. The fluid flow can then continue with little suction effort due to the gravity feed and siphoning effect of fluid from the container. The tubing can be mounted using retainer loops or other type of fasteners attached to a helmet, sports cap, head band bracket, headphone bracket, headband, or an earpiece worn by the user. The hydration delivery system is especially useful for bicycling, canoeing, mountain biking, kayaking, canoe paddling, and rowing environments.

4 Claims, 5 Drawing Sheets

(HELMET MOUNT)

(HELMET MOUNT)

(SPORT CAP MOUNT)

(HEAD BRACKET MOUNT)

(HEADPHONE MOUNT)

(EAR PIECE MOUNT)

(HEAD BAND MOUNT)

HANDS FREE PERSONAL HYDRATION DELIVERY SYSTEM

SPECIFICATION

This U.S. patent application claims the benefit of U.S. Provisional Application 60/125,402 filed on Mar. 20, 1999, entitled "Hydro-Hat, Hands-Free Hydration System".

TECHNICAL FIELD

The invention relates to hydration delivery systems for sports environments, and more particularly, to an improved hands-free type system for bicyclists, canoeists, and the like.

BACKGROUND OF INVENTION

An athlete competing in events such as bicycling, canoeing, rowing, and other sports where the hands are occupied needs a hydration delivery system for water and other fluids which is convenient and can be operated without using the hands. The athlete must stay properly hydrated during endurance sports activities but needs to do it without using the hands. The system should be light, simple, adjustable and easy to use. Previous systems have had inconvenient designs that cause fumbling with the tubing or having to use the hands to drink.

An example of a prior hands-free hydration delivery system is illustrated in U.S. Pat. No. 5,060,833 to Edison, entitled "Camel Back", which disclosure is incorporated herein by reference. This system employs a flexible back pack worn on the back of a bicyclist and connected via a detachable connector to a length of tubing having a tube end with a deformation-type bite valve held in the user's lips and teeth.

However, one problem with the Edison system is that the tube is left dangling, such that release of the tube end from the user's mouth may result in the tube falling away and requiring the user to retrieve it by hand, or may become dislodged when the user suddenly turns the head. Another problem is that the system depends upon the user leaning fully forward, such as over the handlebars of a bicycle, in order for the backpack container to be elevated sufficiently at or above the level of the user's mouth to allow fluid to flow to the tube end by gravity. Hence, the system would require a bicyclist who is not in a full crouch to suck heavily on the tube end in order to draw fluid against gravity from the container. It would not be suitable for use in sports environment where the user's torso is erect, such as for canoeing or rowing.

Other hydration delivery systems have employed various means to overcome the problem of drawing fluid to the user's mouth. U.S. Pat. No. 5,571,260 to Krug discloses a waist-worn bladder from which fluid is pumped up to the user's mouth. U.S. Pat. No. 4,739,905 to Nelson discloses placing beverage containers in holders secured to a cap, and U.S. Pat. No. 4,813,083 to Davidson teaches filling the visor element of a motorcycle helmet with fluid, in order to allow gravity feed of fluid to the user's mouth. U.S. Pat. No. 5,358,142 to Holmes discloses pressurizing a fluid bladder by the user first blowing air into an inner pressurizing bladder. U.S. Pat. No. 5,816,457 to Croft shows a backpack for hikers in which the fluid container is positioned at the top of the backpack at the level of the user's head. U.S. Pat. No. 5,265,769 to Wilson discloses a flow control device that holds the fluid to the point of suction and prevents it from flowing back into the bottle. U.S. Pat. No. 5,465,885 to Wyatt discloses the use of a fluid compartment fitted with an air pressure equalizer valve and a tube end clipped to the user's clothing near the user's mouth. U.S. Pat. No. 5,722,573 to Carnel and U.S. Pat. No. 5,864,880 to Adam show a fluid container held in a user-worn garment with a feed tube exiting near the user's mouth.

However, these other devices requiring a complicated pump, valve, or fluid pressurizing mechanism or mounting of the fluid container at or above the head of the user add to the production cost of the device and/or is inconvenient to assemble or use.

SUMMARY OF INVENTION

In accordance with the present invention, a hands-free personal hydration delivery system comprises: a container for fluid that is worn on the back or torso of a user; an extended length of tubing having one end connected to the container in an air-tight manner and a distal end for providing a flow of fluid into the user's mouth; a bite valve coupled to the distal end of the tubing which is opened when manipulated by the user's mouth to allow fluid to be drawn by suction into the user's mouth, and is closed when not being manipulated so as to cut off fluid flow in an air-tight condition; and mounting means for mounting an intermediate portion of the extended length of tubing to the user's head or headgear at a position of higher elevation than the user's mouth, whereby fluid drawn from the container by suction applied by the user passes upward through the intermediate portion of the tubing elevated above the user's mouth and flows downward from there to the user's mouth by gravity feed, the fluid flow thereby continuing to flow into the user's mouth with little suction effort due to the gravity feed and siphoning effect of fluid from the container. The invention also encompasses the tubing assembly for retrofit by detachably connecting to a container and feed tube.

In a preferred embodiment of the invention, the intermediate portion of tubing is mounted through a series of retainer loops attached to a lower rim of a helmet or cap worn by the user. The loops can be attached to the headgear with adhesive pads or snap rivets. The tubing can be detachably connected to the feed tube from a container. When the length of overall tubing extending from the container to the elevated position of the intermediate portion is about equal to the length from the intermediate portion to the distal end extending to the user's mouth, the amount of suction effort required by the user to keep fluid flow going is minimal.

In alternative embodiments, the intermediate portion of tubing may be mounted to a head bracket or headphone bracket or a headband worn by the user, or to an earpiece mount that rests in the crevice behind the upper lobe of the ear.

Other objects, features, and advantages of the present invention will be explained in the following detailed description of the invention having reference to the appended drawings.

DETAILED DESCRIPTION OF INVENTION

In the present invention, a hands-free personal hydration delivery system improves upon conventional portable liquid delivery systems that require the user to draw fluid with great suction effort from the fluid container or require use of the hands to drink. The invention improves upon conventional hands-free hydration delivery systems, such as represented by U.S. Pat. No. 5,060,833 to Edison, which is incorporated herein by reference. Such systems employ a flexible back pack connected by a detachable connector to a length of tubing having an end with a bite valve held in the user's lips and teeth. The invention provides for convenient mounting of an intermediate portion of the tubing to a part of the person's headgear or head that is elevated above the mouth, in order to provide fluid flow to the user's mouth by gravity feed and continued flow with little suction effort due to gravity and siphoning of fluid from the container.

Figure 1:
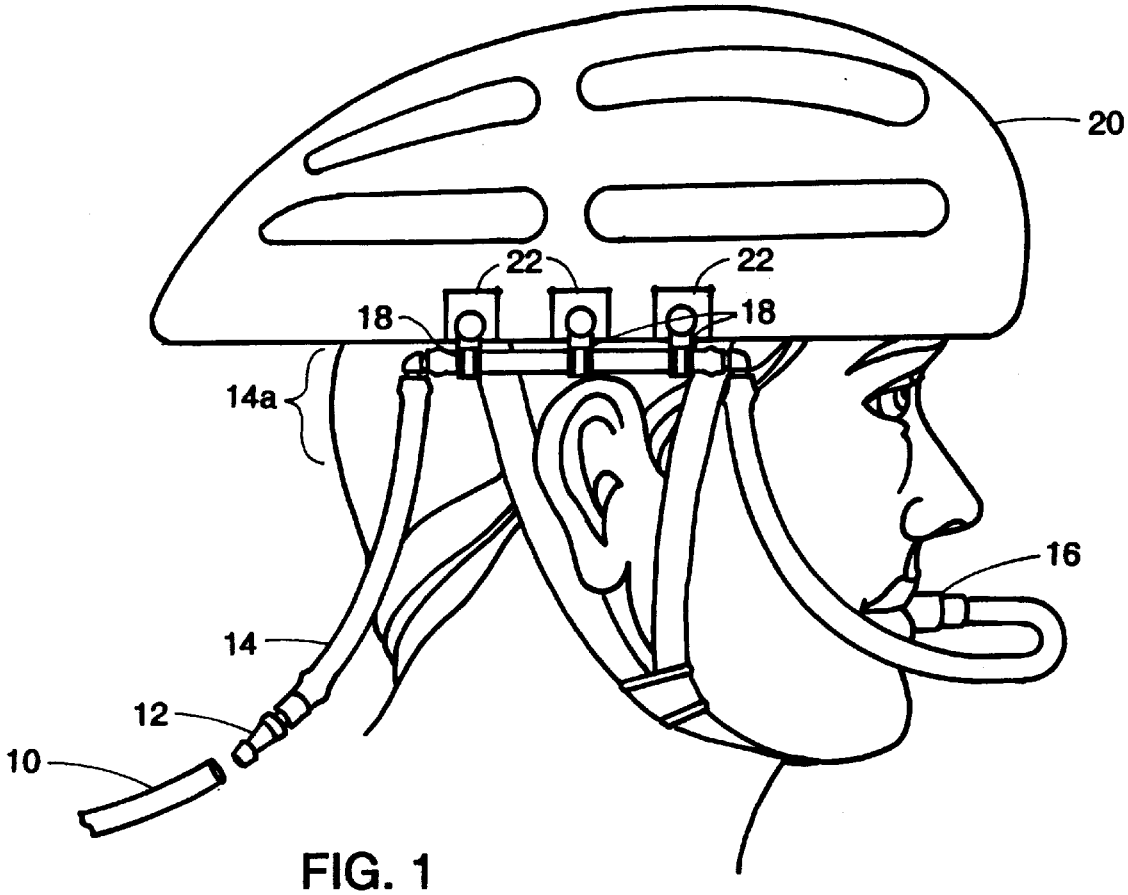
FIG. 1 illustrates a preferred embodiment of the hands-free hydration delivery system of the present invention having an elevated intermediate portion mounted to a helmet, such as used by a bicyclist, canoeist, or other athlete.

Referring to FIG. 1, a preferred embodiment of the hands-free hydration delivery system is shown mounted to a helmet. The system connects detachably to a feed tube 10 coupled in an air-tight manner to a container for fluid worn on the back or torso of the user. The end of the feed tube 10 sleeves by press-fitting over a interference-fit nipple 12 on the end of an attached length 14 of tubing. The other (distal) end of the attached length 14 of tubing is coupled to a bite valve 16 for providing a flow of fluid into the user's mouth. The bite valve is of the type which is opened when manipulated by the user's mouth, and closed when not being manipulated so as to cut off fluid flow from the tubing in an air-tight condition.

The attached length 14 of tubing has an intermediate portion 14*a* which is mounted to a part of the user's body at a position of higher elevation than the user's mouth. In the embodiment of FIG. 1, the intermediate portion 14*a* is mounted through a tube mounting 18 attached to the lower rim of a helmet 20. In this embodiment, the tube mounting is in the form of a series of retainer loops having their ends attached to the helmet by attachment pads 22, such as adhesive or hook-and-fastener type pads. The pads 22 can be retrofitted to a helmet by applying a base adhesive layer (of epoxy or resin adhesive) in contact with the plastic surface of the helmet. Alternatively, the tube mounting may be any other suitable type of fastener, such as snap clips, or a molded construction formed with the helmet.

The attached length 14 of tubing is made of a semi-rigid plastic, such as polyvinylchloride (PVC), nylon, or teflon, and shaped to follow the designed mounting path upward from the feed tube 10 to the rim of the helmet 20 elevated above the mouth and downward with a curve into the user's mouth area. Mounting the intermediate portion 14*a* in the elevated position to the user's headgear or head ensures that a substantial flow length of fluid passes through and can create a gravity feed effect to the user's mouth and also a sufficient siphon effect to draw fluid from the container. The semi-rigid tubing provides enough flexibility to accommodate handling, storage, and use, but also enough rigidity so that the tubing does not dangle away from the user's head or mouth where it may become snared or dislodged from use.

Figure 2:
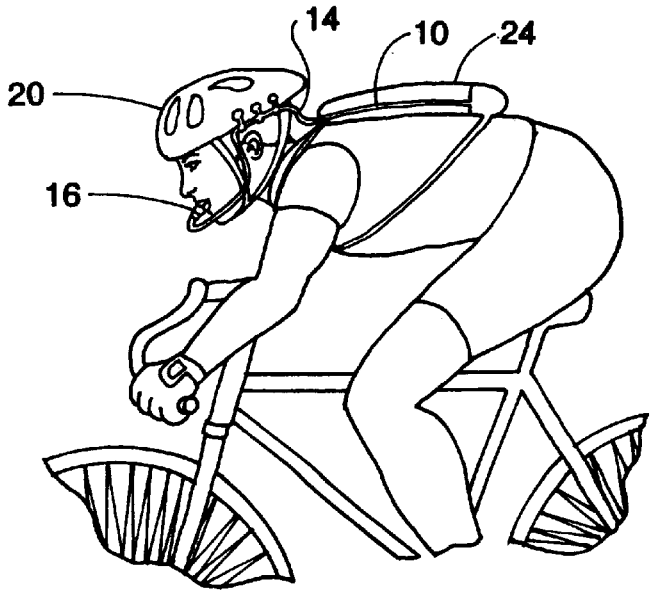
FIG. 2 illustrates the hydration delivery system in use by a bicyclist.

In FIG. 2, the hydration delivery system is shown in use by a bicyclist. The fluid container 24 is worn on the back of the bicyclist (held by backpack straps or a harness) and has the feed tube 10 connected to the attached length 14 of tubing. The attached length 14 of tubing is mounted to the rim of the helmet 20, and the bite valve 16 at the distal end of the tubing is positioned in front of the user's mouth where the user can manipulate it with the lips or teeth.

Figure 3A:
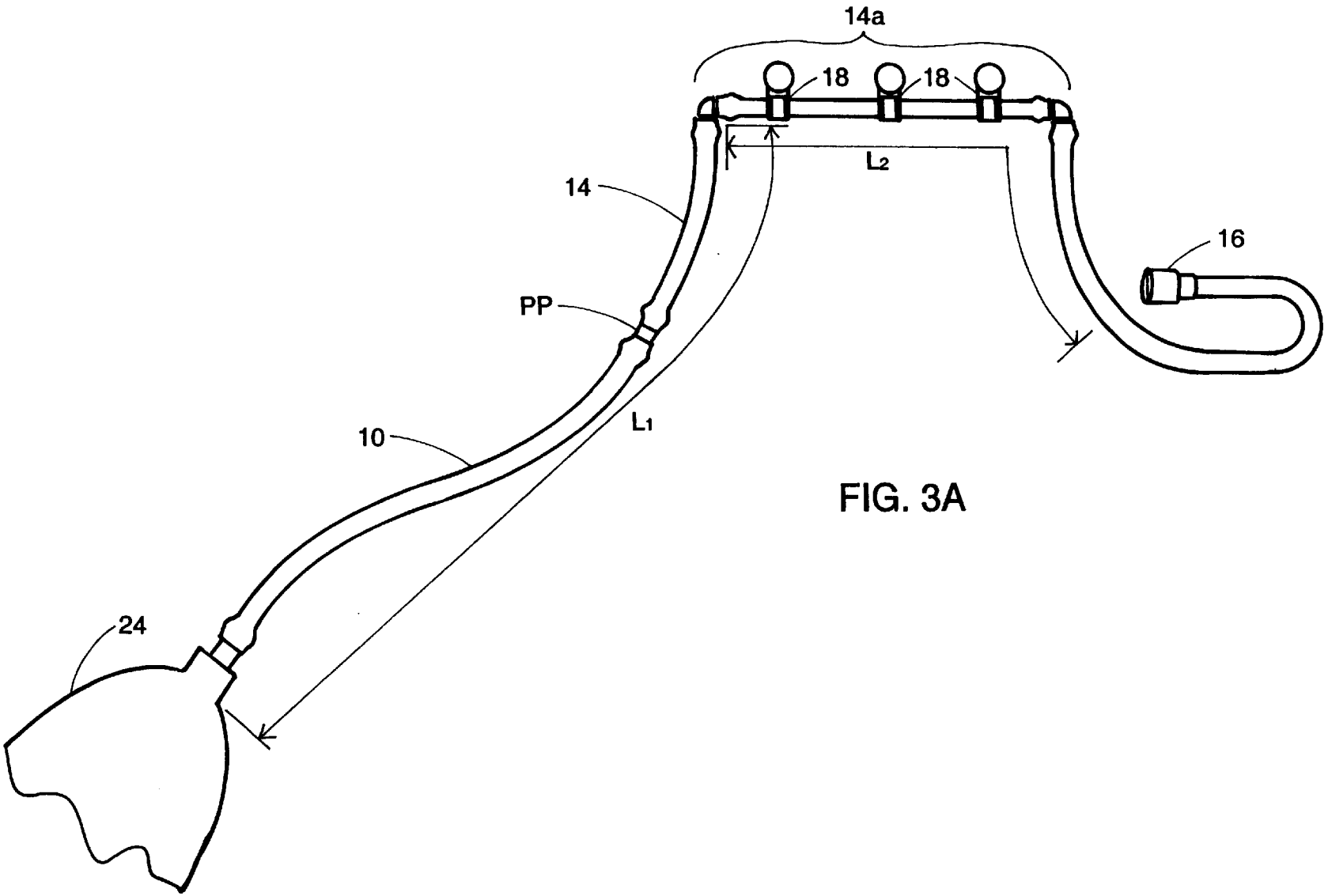
FIG. 3A shows details of the two portions of the tubing connected together and to the fluid container.

In FIG. 3A, the hands-free personal hydration delivery system is shown in further detail. The overall tubing consists of the feed tube portion 10 extending from the fluid container 24 to a detachment point PP, and the attached tube length 14 extending from the detachment point PP to the distal end coupled to the bite valve 16. The intermediate portion 14*a* of the attached tube length 14 is mounted by the tube mounting 18 (retainer loops) to the user's headgear. The bite valve can be of any suitable type, such as the deformation-type disclosed in U.S. Pat. No. 5,060,833, or a simplified type having a slit formed in a flexible mouthpiece.

When the user first opens the bite valve and sucks on the tubing, any air in the tubing is drawn out and fluid commences to flow in the tubing under the suction force. As the fluid flow passes through the intermediate portion and down to the distal end, a substantial length of fluid is held in the intermediate portion which is at an elevated position relative to the distal end at the user's mouth. As a result, the fluid flow to the mouth continues with very little suction effort on the part of the user due to the gravity feed downward. In addition, the siphoning effect of fluid flowing downward from the elevated intermediate portion continues to draw fluid from the container 24 up to the intermediate portion.

The length of elevated fluid which provides the gravity feed effect is indicated by the length L2, whereas the length of fluid to be drawn against gravity from the container is indicated by the Length L1. As the length L2 approaches that of length L1, then the suction effort required of the user to induce fluid flow becomes almost effortless. In tests in bicycling, it is found that inducing a fluid flow is about 3 times easier to maintain than other systems that require the user to pull fluid straight up to the mouth from the reservoir system. This effect is facilitated by the gravity feed of fluid in the length of tubing from the elevated mounting point, providing a continuous even flow of fluid with less drawing effort required, so as not to interfere with the user's strenuous breathing. A typical range for the tubing lengths would be about 30 to 40 cm for the length L2, and about 40 to 60 cm for the length L1.

Once the user has induced a fluid flow through the intermediate portion, the flow can continue with hardly any suction effort on the part of the user. When the user releases the bite valve, the tubing is closed off in an air-tight condition and the fluid in the intermediate portion is retained there so that the next suction by the user is instantly facilitated by the gravity feed and the siphoning effect of the retained fluid. The fluid container can be of the bladder type or the type having an air-equalizer or air-pressurizer which prevents a suctioning back of fluid into the container when the bite valve is released.

Figure 3B:
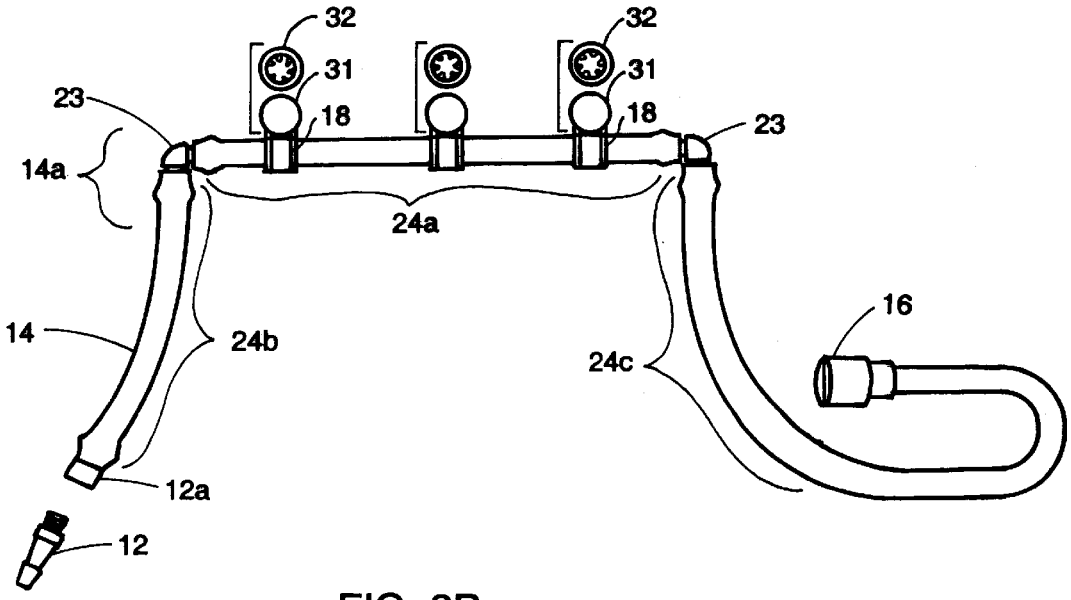
FIG. 3B shows details of the snap rivet mountings and the tubing interconnection elements.

Referring to FIG. 3B, the intermediate portion 14*a* may be formed with a straight segment 24*a* which is held in line through the three retainer loops 18. The straight segment 24*a* is coupled to end segments 24*b* and 24*c* via right-angle tube connectors 23. This structure allows the straight segment to lie in line with the mounting to the user's helmet or other headgear, and to have the back end segment 24*b* run down from the back of the user's head to the container strapped to the back, and the front end segment run down toward the user's mouth. The connector nipple 12 can be of the type that threads into a connector fitting press-fitted into the end of the back end segment 24*b*, to allow replacement or quick detachment of the attached tube length 14 from the feed tube 10 without having to pry the feed tube off the nipple with each detachment. Alternatively, the straight segment of tubing can be molded with the right-angle connectors incorporated.

Figure 4:
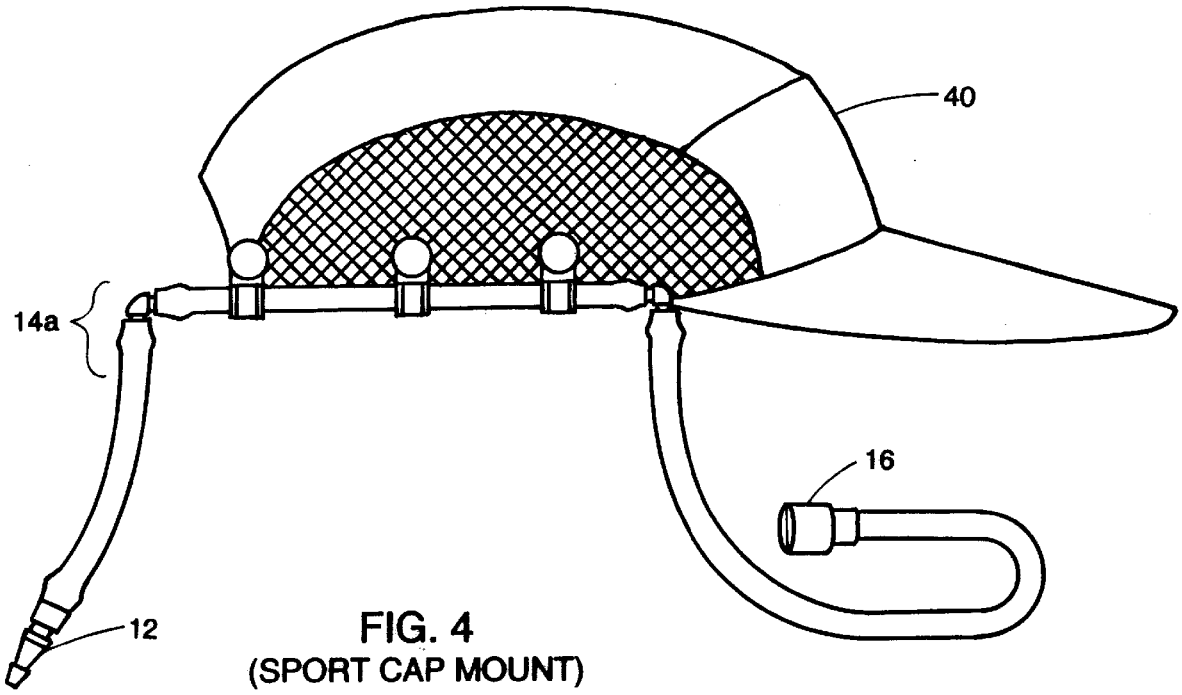
FIG. 4 illustrates an alternate embodiment having the elevated intermediate portion mounted to a sports cap.

In FIG. 4, an alternate embodiment of the invention has the elevated intermediate portion mounted to a sports cap 40. The mounting may employ snap rivets through the fabric at the lower rim of the cap. As shown in FIG. 3B, the snap rivets consists of a male rivet base 32 which is riveted through the fabric of the cap, using a common type of rivet tool, and female snap head 31 which is riveted through the ends of the retainer loops 18. Alternatively, snap clips or a molded construction may be used. This embodiment otherwise is designed and functions in a similar manner as the first described embodiment.

Figure 5:
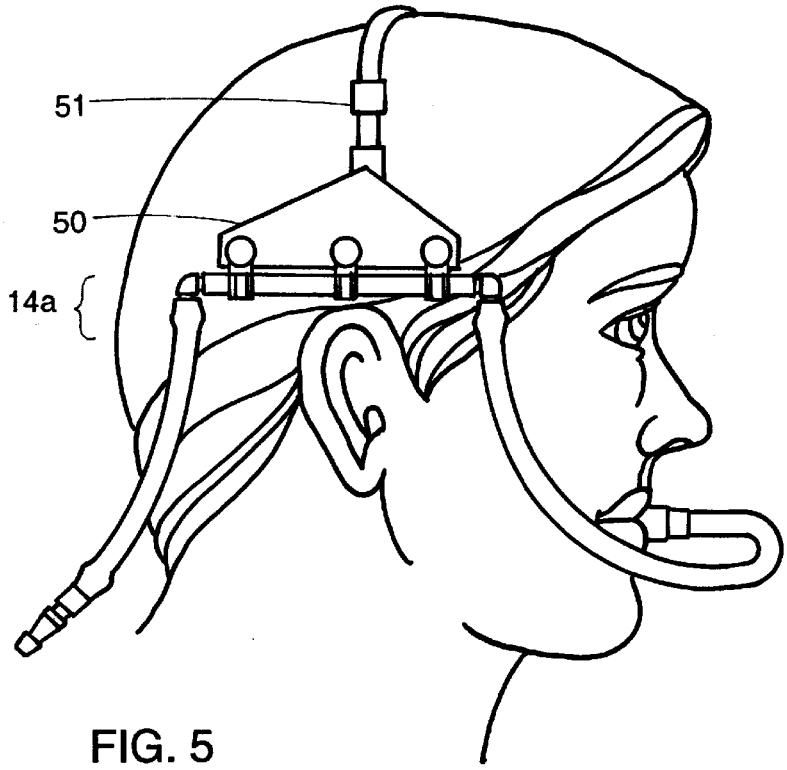
FIG. 5 illustrates an alternate embodiment having the elevated intermediate portion mounted to a head bracket.
Figure 6:
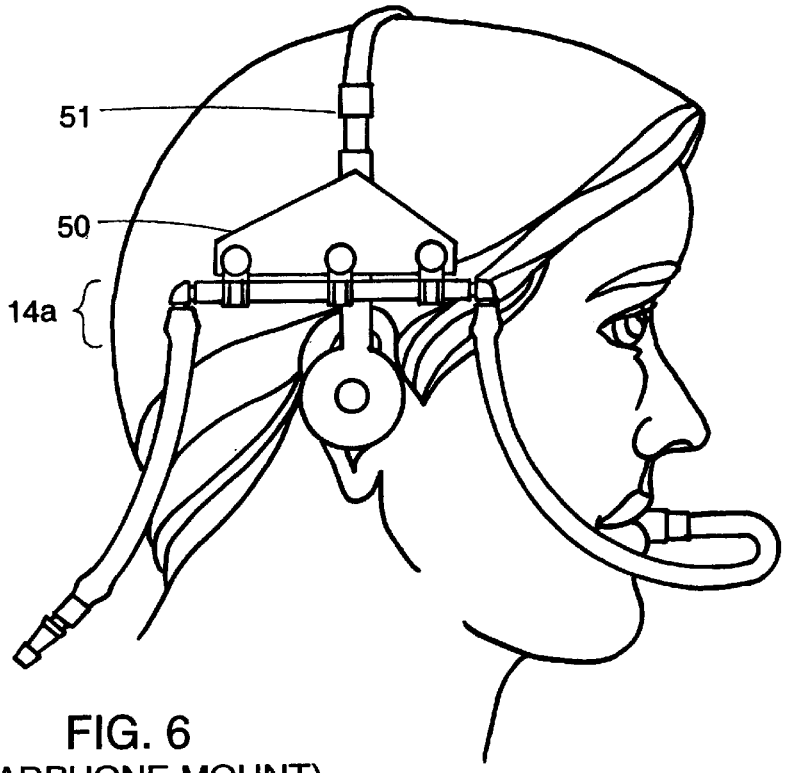
FIG. 6 illustrates an alternate embodiment having the elevated intermediate portion mounted to a headphone bracket.

In FIG. 5, a further embodiment has the intermediate portion of the tubing mounted to a bracket 50 which has a clip on its opposite side (not shown) that clips onto a head band 51 worn over the top of the user's head. The head band 51 can have the sliding expansion band structure commonly used for headphones. In FIG. 6, a headphone mount embodiment is shown having the intermediate portion 14*a* mounted to a headphone band 51' and bracket 50.

Figure 7:
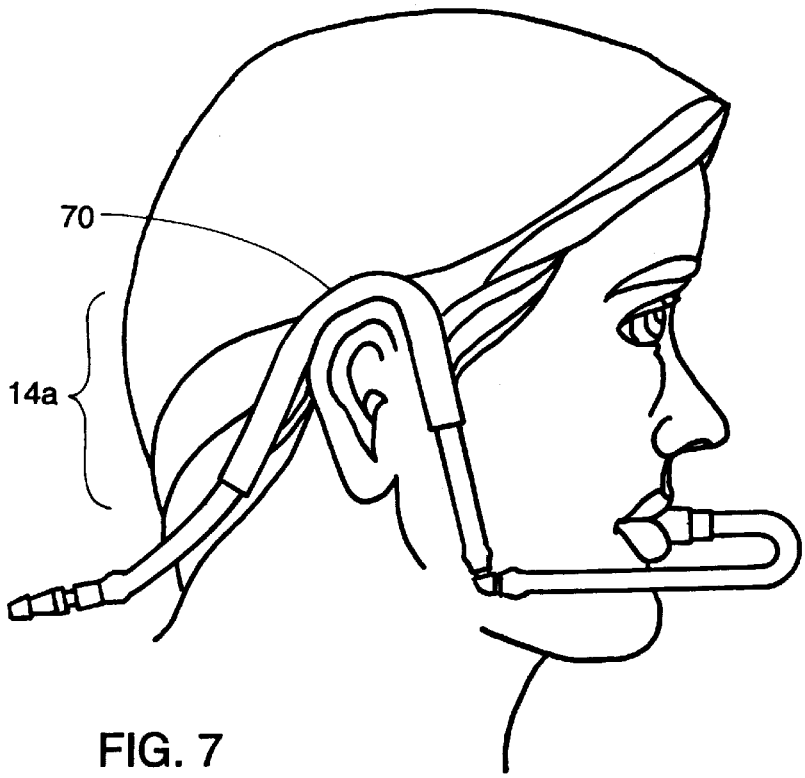
FIG. 7 illustrates an alternate embodiment having the elevated intermediate portion mounted to an earpiece.

FIG. 7 illustrates an earpiece mount embodiment 70 having an elevated intermediate portion 14*a'* of the tubing which is configured to engage the ear of the user when worn in the crevice behind the upper ear lobe.

Figure 8:
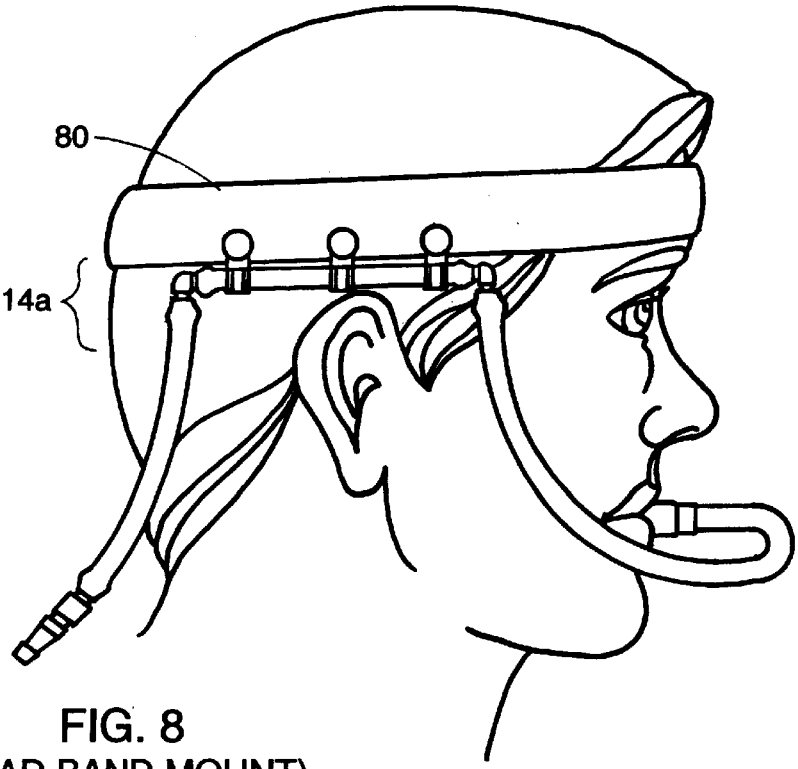
FIG. 8 illustrates an alternate embodiment having the elevated intermediate portion mounted to an headband.

FIG. 8 illustrates an head band mount embodiment having the elevated intermediate portion mounted by snap rivets to a fabric headband 80 worn by the user. The fabric headband can be of the Lycra™ or Spandex™ material sold by DuPont Corporation of Delaware, USA.

The hydration delivery system may be fabricated with molded parts to fit the shape of a person's head and connected with swivel joints and nylon of teflon fittings. The molded shape can bend around from the rear of the head to the temple on the side of the head, and joined or molded with 90 degree plastic fittings. The tubing can drop down the side of the face and bend forward to the front of the face at chin level. The tubing then curves around 180 degrees to be positioned in front of mouth where it can be readily accessed by extending the lips or teeth to the bite valve to release fluid for easy drinking. A typical diameter for the plastic tube is about ¼ inch, or 6 cm.

A typical system can be assembled from cut segments of ¼" nylon tubing. The segments are molded into shape with heat to soften the tubing before inserting into a mold, then cooled down. The ends of the straight head segment are fitted with barbed ¼" 90-degree tubular connectors. The front and rear end segments are then press-fitted onto the ends of the 90-degree connectors. The other end of the rear segment is fitted with a ¼" swiveling connect/disconnect tube coupler. The distal end of the front segment is attached to a bite-activated flow valve. The straight segment is then fitted into three ⅜" nylon loop retainers with ends that are closed and riveted together with "female" snap fasteners. Three "male" snap fasteners are spaced approximately 1 inch apart and attached to the lower rim of the headgear along the area from the temple to the rear of headgear. The assembled headgear-mounted tubing can then be connected to the feed tube of the back-mounted fluid bladder for use.

All components of the system are made to be detachable or easily adjustable so they may be adjusted to fit the head properly. The fluid reservoir is preferably of the bladder type to keep air out of the system. The hydration delivery system of the invention has been tested in bicycling, canoeing, mountain biking, kayaking, canoe paddling, and rowing environments, and found to perform extremely well.

It is understood that many modifications and variations may be devised given the above description of the principles of the invention. It is intended that all such modifications and variations be considered as within the spirit and scope of this invention, as defined in the following claims.

I claim:

1. A hands-free personal hydration delivery system comprising:

a container for fluid which is adapted to be worn on the back or torso of a user;

an extended length of tubing having a connection end connected to the container in an air-tight manner, a distal end adapted to be held in the user's mouth for providing a flow of fluid into the user's mouth, and an intermediate portion, to be mounted to a headgear worn on the user's head;

a bite valve coupled to the distal end of the extended length of tubing which is adapted to be opened when manipulated by the user's mouth to allow fluid to be drawn by suction into the user's mouth, and closed when not being manipulated so as to cut off fluid flow in an air-tight condition;

a headgear adapted to be worn on the user's head at a vertical height above the user's mouth; and a mounting element mounted to the headgear so as to be positioned at a vertical height above the user's mouth for retaining the intermediate portion of the extended length of tubing at a position of higher elevation than the user's mouth, whereby the higher elevation of the intermediate portion ensures that fluid drawn from the container by suction applied by the user passes upward through the intermediate portion of the tubing elevated above the user's mouth and flows downward from there to the user's mouth by gravity feed, the fluid flow thereby continuing to flow into the user's mouth with little suction effort due to the gravity feed and siphoning effect of fluid from the container, wherein the headgear is a helmet and the intermediate portion of the tubing is mounted to a lower rim of the helmet, and wherein the mounting element is an attachment pad that is applied by a base adhesive layer to the helmet.

2. A hands-free personal hydration delivery system according to claim 1, wherein a feed end of the extended length of tubing has a detachable fitting for detachably mounting it to a feed tube coupled to the fluid container.

3. A hands-free personal hydration delivery system according to claim 2, wherein a second length measured from the intermediate portion of the extended length of tubing to its distal end is about the same length as a first length measured from the intermediate portion of the extended length of tubing including the feed tube to the container.

4. A method for mounting a tubing assembly to a fluid container and using the assembly as a hands-free personal hydration delivery system, the fluid container being of the type having a feed tube for supplying fluid from the container and being worn on the back or torso of a user, said method comprising:

providing an extended length of tubing having a connection end provided with a detachable connection for connecting to an end of the feed tube from the container in an air-tight manner, a distal end adapted to be held in the user's mouth for providing a flow of fluid from the container into the user's mouth, and an intermediate portion; and mounting the intermediate portion of the extended length of tubing to a headgear worn by the user at a position of higher elevation than the user's mouth, whereby the higher elevation of the intermediate portion ensures that fluid drawn from the container by suction applied by the user passes upward through the intermediate portion of the tubing elevated above the user's mouth and flows downward from there to the user's mouth by gravity feed, the fluid flow thereby continuing to flow into the user's mouth with little suction effort due to the gravity feed and siphoning effect of fluid from the container, wherein the headgear is a helmet and the intermediate portion of the tubing is mounted to a lower rim of the helmet, and wherein the mounting element is an attachment pad that is applied by a base adhesive layer to the helmet.

* * * * *